US011092342B2

(12) United States Patent
Harrington et al.

(10) Patent No.: US 11,092,342 B2
(45) Date of Patent: Aug. 17, 2021

(54) NON-GAS FIRE PIT

(71) Applicant: Lamplight Farms Incorporated, Menomonee Falls, WI (US)

(72) Inventors: Steven Merrill Harrington, Cardiff by the Sea, CA (US); Michael Sawalski, Racine, WI (US); Ryan Butrym, Cardiff by the Sea, CA (US); Robert Woodruff, Oconomowoc, WI (US)

(73) Assignee: LAMPLIGHT FARMS INCORPORATED, Menomonee Falls, WI (US)

( * ) Notice: Subject to any disclaimer, the term of this patent is extended or adjusted under 35 U.S.C. 154(b) by 198 days.

(21) Appl. No.: 16/578,926

(22) Filed: Sep. 23, 2019

(65) Prior Publication Data

US 2020/0096199 A1 Mar. 26, 2020

Related U.S. Application Data

(60) Provisional application No. 62/734,753, filed on Sep. 21, 2018.

(51) Int. Cl.

| | |
|---|---|
| ***F24B 1/19*** | (2006.01) |
| ***F24B 1/193*** | (2006.01) |
| ***F24B 13/00*** | (2006.01) |
| ***F24B 5/02*** | (2006.01) |
| ***F24B 1/191*** | (2006.01) |

(52) U.S. Cl.

CPC ..... *F24B 1/19* (2013.01); *F24B 1/193* (2013.01); *F24B 1/1915* (2013.01); *F24B 5/025* (2013.01); *F24B 13/008* (2013.01)

(58) Field of Classification Search

CPC ..... F24B 1/19; F24B 1/193

See application file for complete search history.

(56) References Cited

U.S. PATENT DOCUMENTS

| | | | | |
|---|---|---|---|---|
| 1,279,033 A | | 9/1918 | Stollberg | |
| 1,504,924 A | * | 8/1924 | Anderson | F28D 7/1669 122/339 |
| 2,001,360 A | | 5/1935 | Heuston | |

(Continued)

FOREIGN PATENT DOCUMENTS

| | | |
|---|---|---|
| CN | 112524644 A | 3/2021 |
| EP | 3222177 A1 | 9/2017 |

(Continued)

*Primary Examiner* — David J Laux

(74) *Attorney, Agent, or Firm* — David G. Woodral; GableGotwals

(57) ABSTRACT

A fire an inner chamber wall circumscribing and defining an inner chamber. A plurality of primary air apertures defined through the inner chamber wall at a first, lower level and a plurality of secondary air apertures defined through the inner chamber wall at a second, upper level. A fuel grate is supported within the inner chamber at a level between the lower level and the upper level. Solid fuel supported by the fuel grate, when combusted, is provided primary combustion air from below the fuel grate by the primary air apertures and provided secondary combustion air from above the solid fuel by the secondary air apertures, the secondary combustion air promoting combustion of unburned gasified combustibles rising within the inner chamber.

18 Claims, 10 Drawing Sheets

(56) References Cited

U.S. PATENT DOCUMENTS

| | | | | |
|---|---|---|---|---|
| 2,303,406 | A * | 12/1942 | Smerling | F23H 9/02 110/277 |
| 3,915,144 | A | 10/1975 | Tomita | |
| D258,259 | S | 2/1981 | Lindholm | |
| D273,264 | S | 4/1984 | Elliston | |
| 4,651,708 | A | 3/1987 | Groeneweg | |
| 4,825,845 | A | 5/1989 | Olivotti | |
| 5,094,223 | A | 3/1992 | Gonzalez | |
| 5,203,316 | A | 4/1993 | Pritchett | |
| D375,347 | S | 11/1996 | Whalen et al. | |
| D397,428 | S | 8/1998 | Reitsma et al. | |
| 5,836,298 | A | 11/1998 | Grady | |
| 5,960,788 | A | 10/1999 | Bach | |
| 5,992,675 | A | 11/1999 | Kerr | |
| 6,050,256 | A | 4/2000 | French | |
| 6,056,146 | A | 5/2000 | Varakian | |
| D457,229 | S | 5/2002 | Chen | |
| D729,914 | S | 5/2015 | Kinchen et al. | |
| 9,038,620 | B2 | 5/2015 | Brown | |
| D757,238 | S | 5/2016 | Horsfield | |
| 9,839,320 | B2 | 12/2017 | Robb | |
| D820,021 | S | 6/2018 | Henderson | |
| 10,022,013 | B2 | 7/2018 | Colwell | |
| 10,058,210 | B2 | 8/2018 | Palermo | |
| 2003/0029443 | A1 | 2/2003 | Davis et al. | |
| 2003/0075166 | A1 | 4/2003 | Glass | |
| 2004/0255930 | A1 | 12/2004 | Klemming | |
| 2008/0296303 | A1 | 12/2008 | Krent | |
| 2009/0321459 | A1 | 12/2009 | Maczko et al. | |
| 2010/0288263 | A1 | 11/2010 | Sykes et al. | |
| 2011/0271949 | A1 | 11/2011 | Ortner et al. | |
| 2012/0196232 | A1 | 8/2012 | Miller | |
| 2012/0210994 | A1 | 8/2012 | Gulotta | |
| 2014/0238378 | A1 | 8/2014 | Scott | |
| 2015/0069078 | A1 | 3/2015 | Hawker | |
| 2016/0374512 | A1 | 12/2016 | Reiner | |
| 2017/0071406 | A1 | 3/2017 | Huttner | |
| 2017/0114996 | A1 | 4/2017 | Moneyhun | |
| 2018/0042426 | A1 | 2/2018 | Henry et al. | |
| 2019/0162411 | A1 | 5/2019 | Choi et al. | |
| 2019/0313851 | A1 | 10/2019 | Shemp | |
| 2020/0208842 | A1 | 7/2020 | Jan et al. | |
| 2021/0018180 | A1 | 1/2021 | Jan et al. | |
| 2021/0048188 | A1 | 2/2021 | Harrington | |

FOREIGN PATENT DOCUMENTS

| | | | |
|---|---|---|---|
| WO | 2013116502 | A1 | 8/2013 |
| WO | 2018160767 | A1 | 9/2018 |

* cited by examiner

NON-GAS FIRE PIT

CROSS-REFERENCE TO RELATED CASES

This application claims the benefit of U.S. provisional patent application Ser. No. 62/734,753, filed on Sep. 21, 2018, and incorporates such provisional application by reference into this disclosure as if fully set out at this point.

FIELD OF THE INVENTION

This disclosure relates to fire pits in general and, more specifically, to non-gas-burning fire pits.

BACKGROUND OF THE INVENTION

Outdoor fire pits have, in the past, been permanent fixtures built from rock, concrete, metals, or other resilient and heavy materials. Often the fire pit is built directly on the ground and is not readily portable. Other fire pits have been developed that may be somewhat portable. However, in an effort to contain fire and ash combustion properties are less than desirable. Smoky fires, possibly with little light or radiated heat, have been the result.

What is needed is a system, device, and method for addressing the above, and related, concerns.

SUMMARY OF THE INVENTION

The invention of the present disclosure, in one aspect thereof, comprises a fire pit with an inner chamber wall circumscribing and defining an inner chamber. A plurality of primary air apertures are defined through the inner chamber wall at a first, lower level and a plurality of secondary air apertures are defined through the inner chamber wall at a second, upper level. A fuel grate is supported within the inner chamber at a level between the lower level and the upper level. Solid fuel supported by the fuel grate, when combusted, is provided primary combustion air from below the fuel grate by the primary air apertures and provided secondary combustion air from above the solid fuel by the secondary air apertures, the secondary combustion air promoting combustion of unburned gasified combustibles rising within the inner chamber.

The fire pit may further comprise an outer wall surrounding the inner chamber wall, the inner chamber wall and the outer wall defining an air intake chamber wherein air rises in proximity to the inner chamber wall and is heated before passing into the secondary air apertures. The outer wall may define at least one space for air to enter the air intake chamber from outside the fire pit and may also comprise a plurality of spaced apart slats. The plurality of spaced apart slats may be oriented horizontally.

In some embodiments, the inner chamber wall is frustoconical and is narrower toward a top thereof. The outer wall may be frustoconical and narrower toward a bottom thereof. A top panel may span a distance between the top of the inner chamber wall and a top of the outer wall. The air intake chamber may be toroidal.

The fire pit may have a deflector seated on the fuel grate and having a wall sloping downward and away from above a central, inner area of the fuel grate such that fuel will tend to slide away from the central, inner area of the fuel grate to combust on an outer annular area of the fuel grate proximate the inner chamber wall. In some embodiments, the deflector is conic and is located on the fuel grate by a support ring on the fuel grate, the support ring defining a boundary between the inner area of the fuel grate and the outer area of the fuel grate.

The fire pit may have a base below the inner chamber, the base providing a floor surrounded by a wall and a funnel for moving ash from the fuel grate toward a center of the base. The base may further comprise a removable ash pan inserted by an opening defined in the base wall.

The invention of the present disclosure, in another aspect thereof, comprises a fire pit having an inner chamber wall circumscribing and defining an inner chamber, a plurality of primary air apertures defined through the inner chamber wall at a first, lower level, and a plurality of secondary air apertures defined through the inner chamber wall at a second, upper level. The fire pit has a fuel grate supported within the inner chamber at a level between the lower level and the upper level and an outer wall surrounding the inner chamber wall to define an air intake chamber therebetween. Solid fuel supported by the fuel grate, when combusted, is provided primary air from below the fuel grate by the primary air apertures and provided secondary air above the solid fuel by the secondary air apertures, the secondary air promoting combustion of unburned gasified combustibles rising within the inner chamber. At least some air entering the inner chamber via the secondary air apertures is heated by passing in proximity to the inner chamber wall through the air intake chamber.

In some embodiments, the outer wall comprises a plurality of horizontally oriented, spaced apart slats, spaces between the slats admitting air from outside the fire pit to the air intake chamber. The primary air apertures may be fed combustion air from the air intake chamber.

In some cases the inner chamber wall is frustoconical with a smaller upper end and a larger lower end and the outer wall is frustoconical with a larger upper and a smaller lower end, the inner chamber wall and the outer wall joining at the lower ends thereof and being spaced apart at the upper ends thereof, the space being covered by a top panel to enclose the air intake chamber.

Some fire pits have a fuel grate that further comprises a centrally located deflector urging fuel away from a center of the fuel grate and toward an outer area proximate the inner chamber wall. The deflector, the fuel grate, the inner chamber wall, and the outer wall may all be all concentrically arranged with respect to one another. A base below the fuel grate may provide a funnel feeding into an ash pan for capturing ash falling through the fuel grate.

DETAILED DESCRIPTION OF THE PREFERRED EMBODIMENTS

Figure 1:
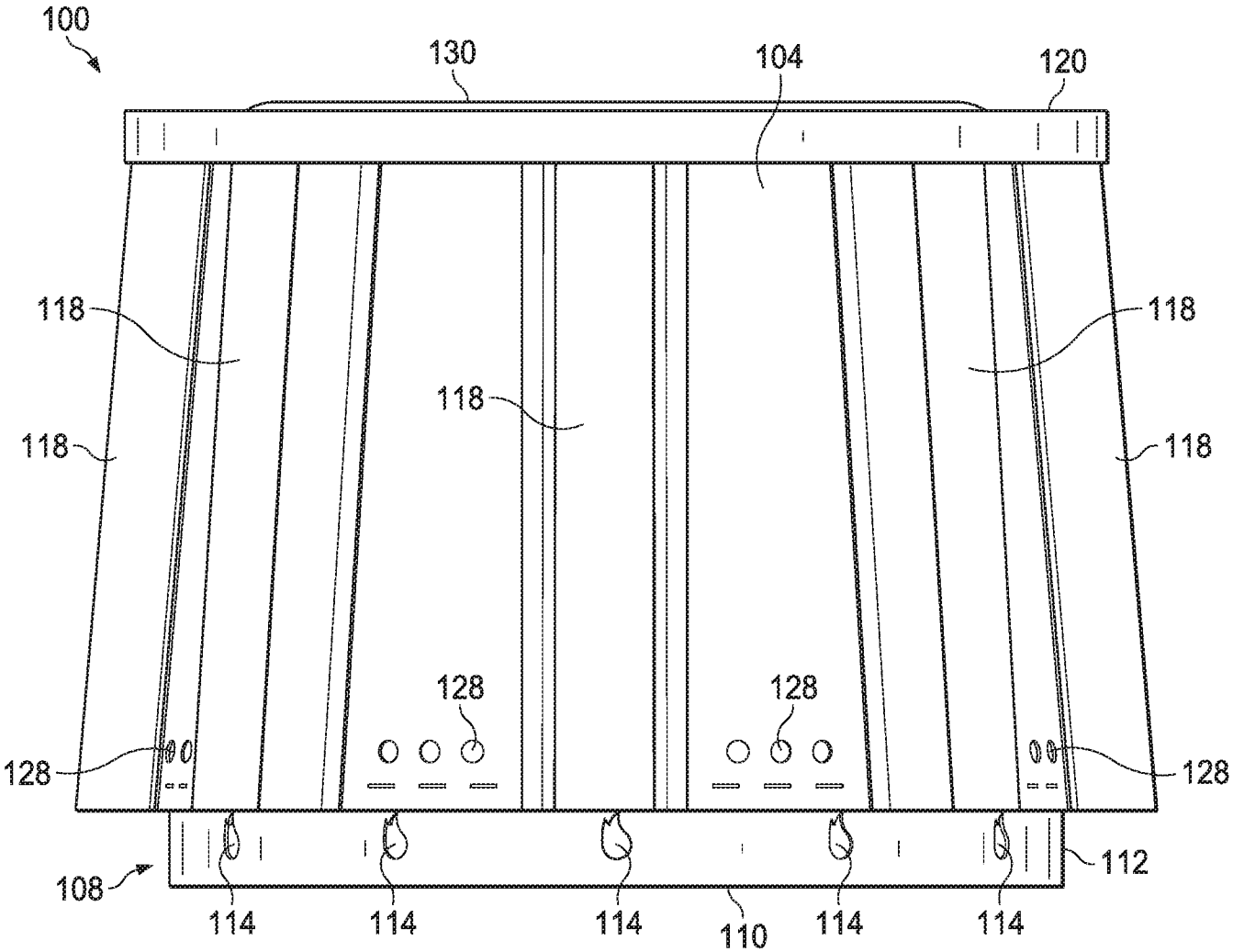
FIG. 1 is a side view of one embodiment of a fire pit according to aspects of the present disclosure.
Figure 2:
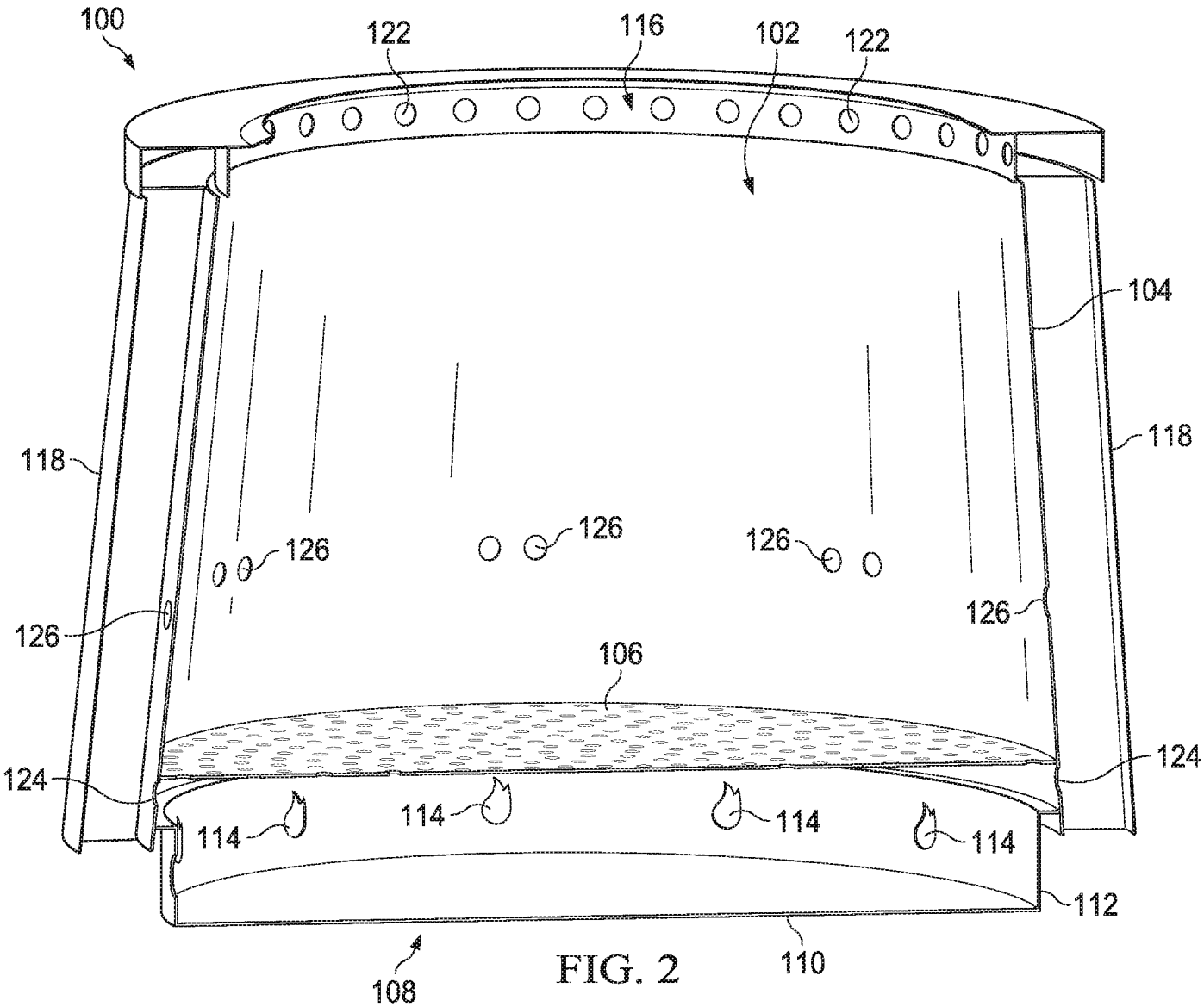
FIG. 2 is a side cutaway view of the fire pit of FIG. 1.
Figure 3:
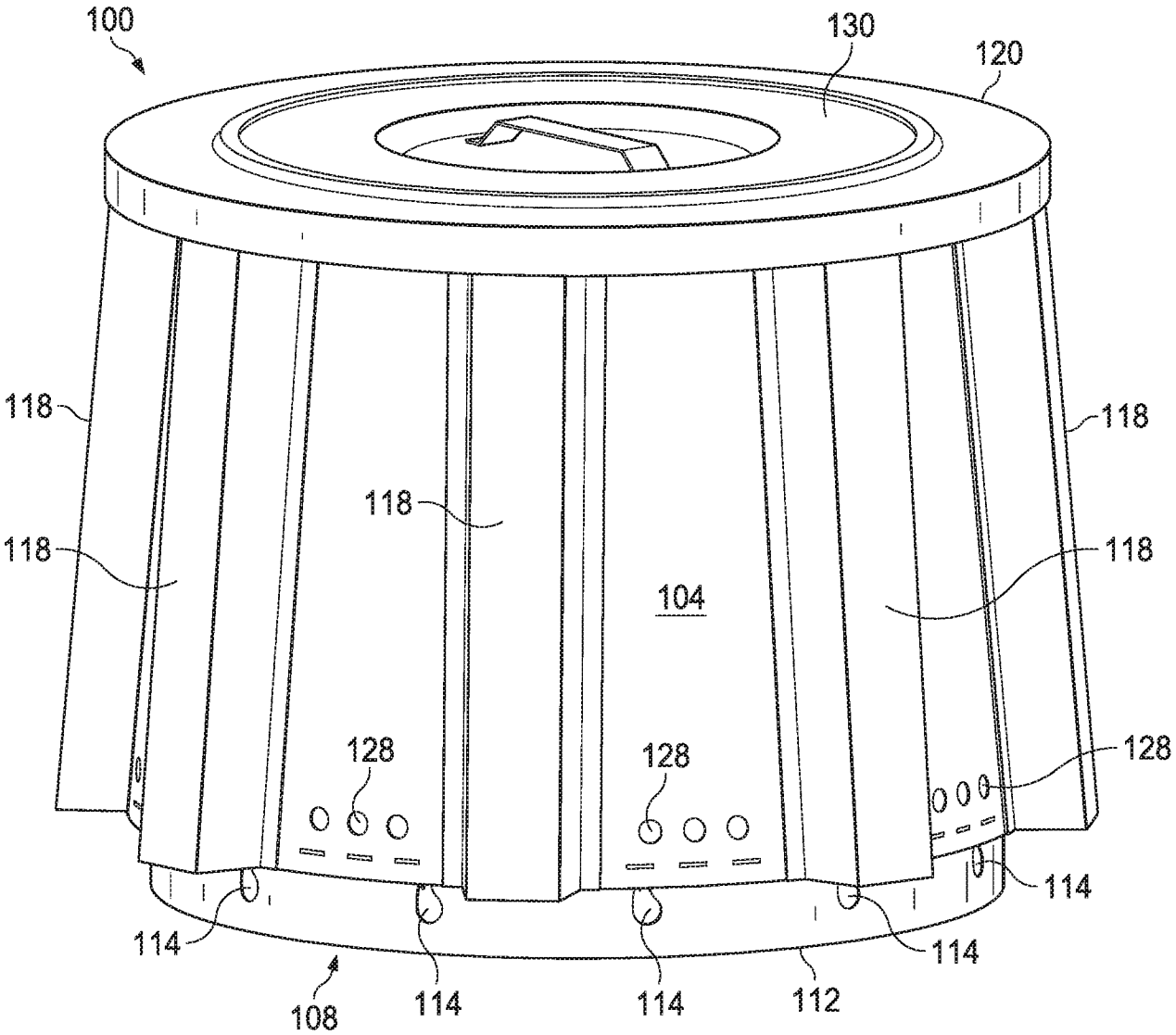
FIG. 3 is a perspective view of the fire pit of FIG. 1.
Figure 4:
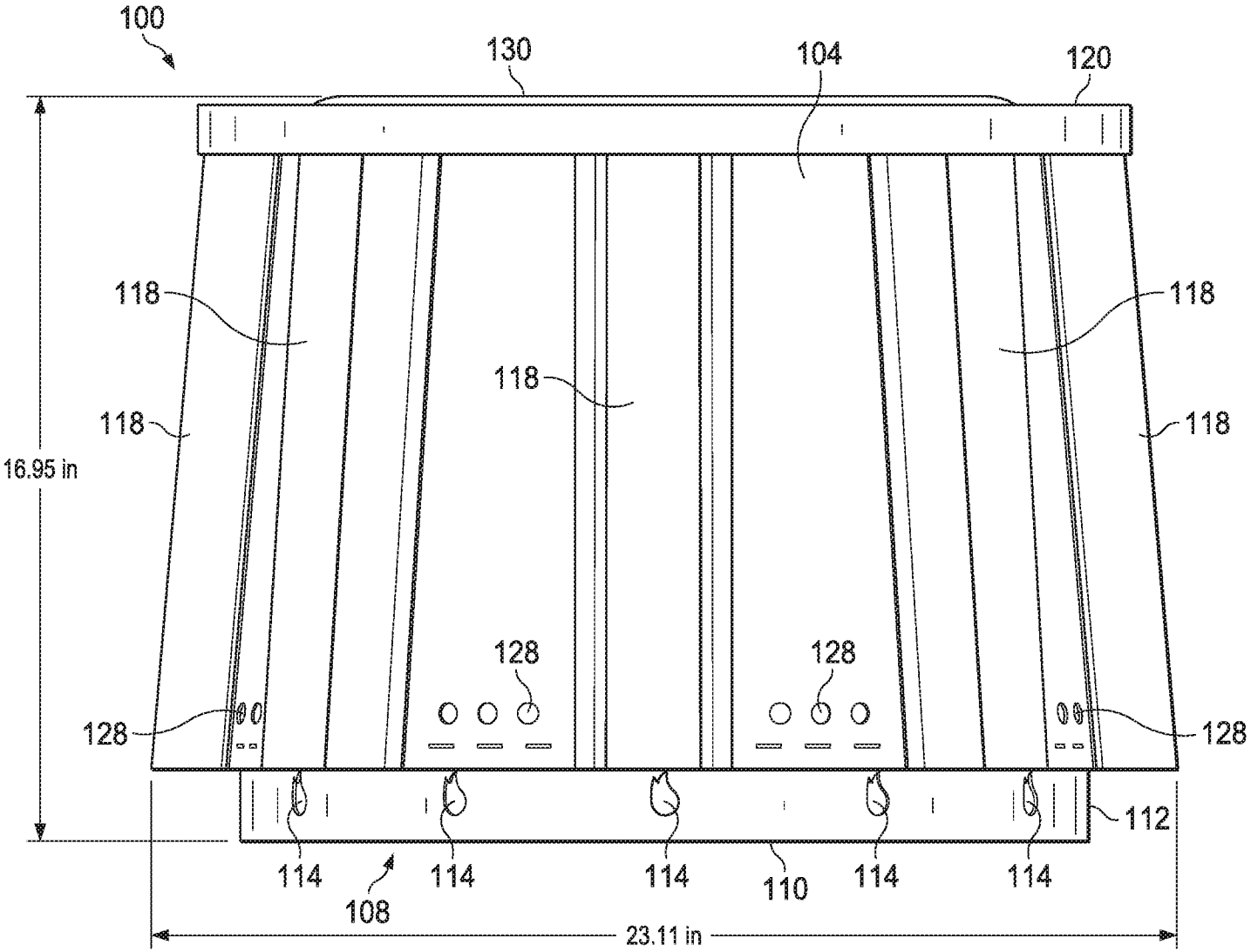
FIG. 4 is a side view with indicated dimensions of the fire pit of FIG. 1.

Referring now to FIGS. 1-4, a fire pit 100 can be seen. FIG. 1 is a side view of the fire pit 100 while FIG. 2 is a side cutaway view, FIG. 3 is a perspective view, and FIG. 4 is a side view with indicated exemplary dimensions of the fire pit of FIG. 1.

The fire pit 100 may be configured to burn wood pellets, whole sticks of wood, charcoal, or another suitable solid fuel. The fire pit 100 provides an inner chamber 102 bound by an inner chamber wall 104. In various embodiments, the inner chamber 102 is frustoconical in shape and may taper from a relatively wider base to a relatively narrower upper end. Various structures and components of the fire pit 100, including the inner chamber wall 104, may comprise stainless steel or another suitably heat resistant material. The inner chamber wall 104 may be uninsulated and/or of a single layer or thickness. The inner chamber wall 104 is intended to radiate heat from an internal fire outward and away from the fire pit 100 to be enjoyed by a user of the fire pit 100.

The inner chamber 102 may have a fuel support grate 106 at or near a bottom end thereof. The grate 106 supports burning fuel and may allow ash to fall therethrough. Combustion air may be provided upwardly through the grate 106. The inner chamber 102 may rest upon or attach to a base 108, that may be pan-shaped to retain ash from the fuel support grate 106. The base 108 may have a pan 110 with a perimeter affixed to an upright, possibly cylindrical portion 112 supporting the inner chamber wall 104. Air intake openings 114 may be provided in the upright portion 112 for feeding combustion air to the fuel support grate 106. In some embodiments, the inner chamber wall 104 is separable from the base 108 to facilitate emptying of ashes and other cleaning tasks.

In operation, as fuel is combusted on the fuel support grate 106, heated gases rise through the inner chamber 102 and out through a top opening 116 in the upper narrower portion of the inner chamber 102. Gases rising from the fuel on the fuel support grate 106 may not be completely combusted and performance of the fire pit 100 may be altered by providing additional air into the inner chamber 102. In various embodiments, a number of outer chambers 118 may be configured to provide additional air that may be drawn along the outside of the inner chamber wall 104. The inner chamber wall 104 may provide heating of air drawn into the outer chambers 118 thereby promoting rapid combustion inside the inner chamber 102 when the air drawn in through the secondary chambers 118 reaches incompletely combusted gases within the inner chamber 102.

In the present embodiment, there are eight secondary chambers 118 spaced roughly equidistantly around the inner chamber wall 104. However, more or fewer secondary chambers 118 may be utilized. In various embodiments, the secondary chambers 118 may cover less than half of the total outer surface area of the inner chamber wall 104. In this way, a user may experience an adequate level of radiated or infrared heat from the inner chamber wall 104, while a sufficient amount of heat is also transferred to the air inside the secondary chambers 118 to promote rapid combustion upon entering the inner chamber 102.

An upper manifold 120 may be provide at or near the top of the inner chamber 102. The manifold accepts incoming heated air from the secondary chambers 118 that may be expelled via a plurality of inward facing apertures 122. The apertures 122 provide "jets" of heated combustion-promoting air to the hot and incompletely combusted gases rising from the fuel on the fuel support grate 106. This additional air promotes further combustion of the gases resulting in an increase in visible flames and heat, and a decrease in smoke resulting from otherwise incomplete combustion.

In some embodiments, a number of additional air inlets to the inner chamber may be provided directly from the secondary chambers 118. As best seen in FIG. 2, supplemental air intakes 124 may be provided below the level of the fuel support grate 106. These air intakes 124 may provide air that has received some degree of heating, but will not feed air to incompletely combusted gases as incompletely combusted gases will not occur until air has been drawn through, over, or across combusting fuel on the fuel support grate 106. Additionally, the degree of heating may be somewhat low at this point such that the supplemental air intakes 124 are essentially providing supplemental primary combustion air along with the air intakes 114.

Intermediate air intakes 126 may be formed at some elevation between the fuel support grate 106 and the upper manifold 120 as apertures in the inner chamber all 104 into respective secondary chambers 118. In the present embodiment, the air intakes 126 are formed roughly one third of the way up the inner chamber wall 104, but this may vary depending on desired performance. The higher the location of the air intakes 126 the more heating the air will have received before it enters the inner chamber 102 from the secondary chamber 118. However, the air intakes 126 are optional as are their size, number, and location.

On approximately the same level as supplemental air intakes 124 are unheated air intakes 125 that open directly to the outer atmosphere from the inner chamber 102. These air intakes 125 are optional as well and may be considered as providing additional primary combustion air. The air intakes 125 may be formed by apertures defined in respective portions of the inner chamber wall 104.

As best seen in FIG. 3, the fire pit 100 may be provided with a lid 130. The lid 130 serves to keep rain and other contaminants out of the fire pit 100 when not in use. In some embodiments, the total height of the fire pit 100 may be about 16.95 inches. The width at the widest point may be about 23.11 inches. Different embodiments may have dimensions that differ from these.

Figure 5:
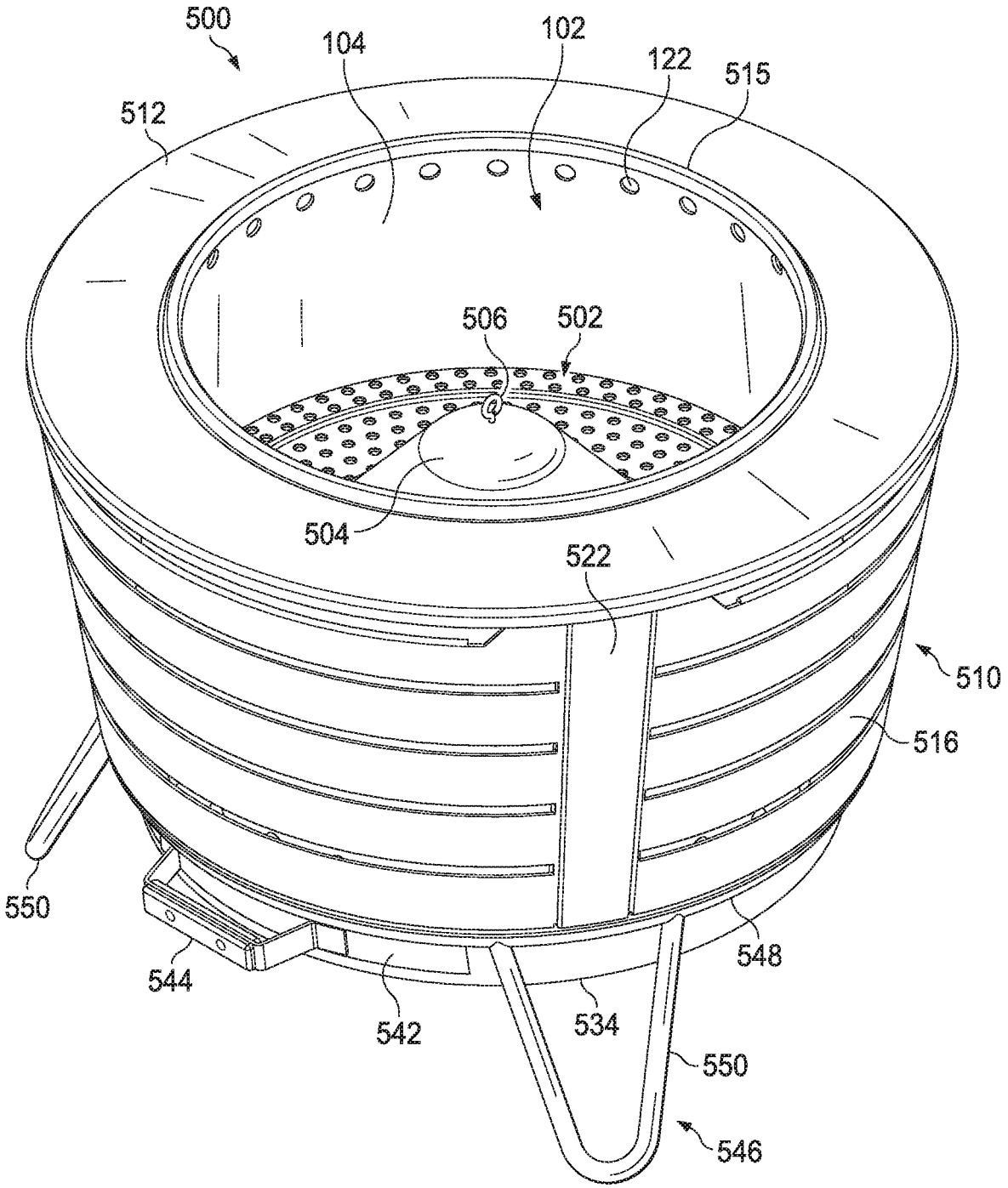
FIG. 5 is a side perspective view of another embodiment of a fire pit according to aspects of the present disclosure.
Figure 6:
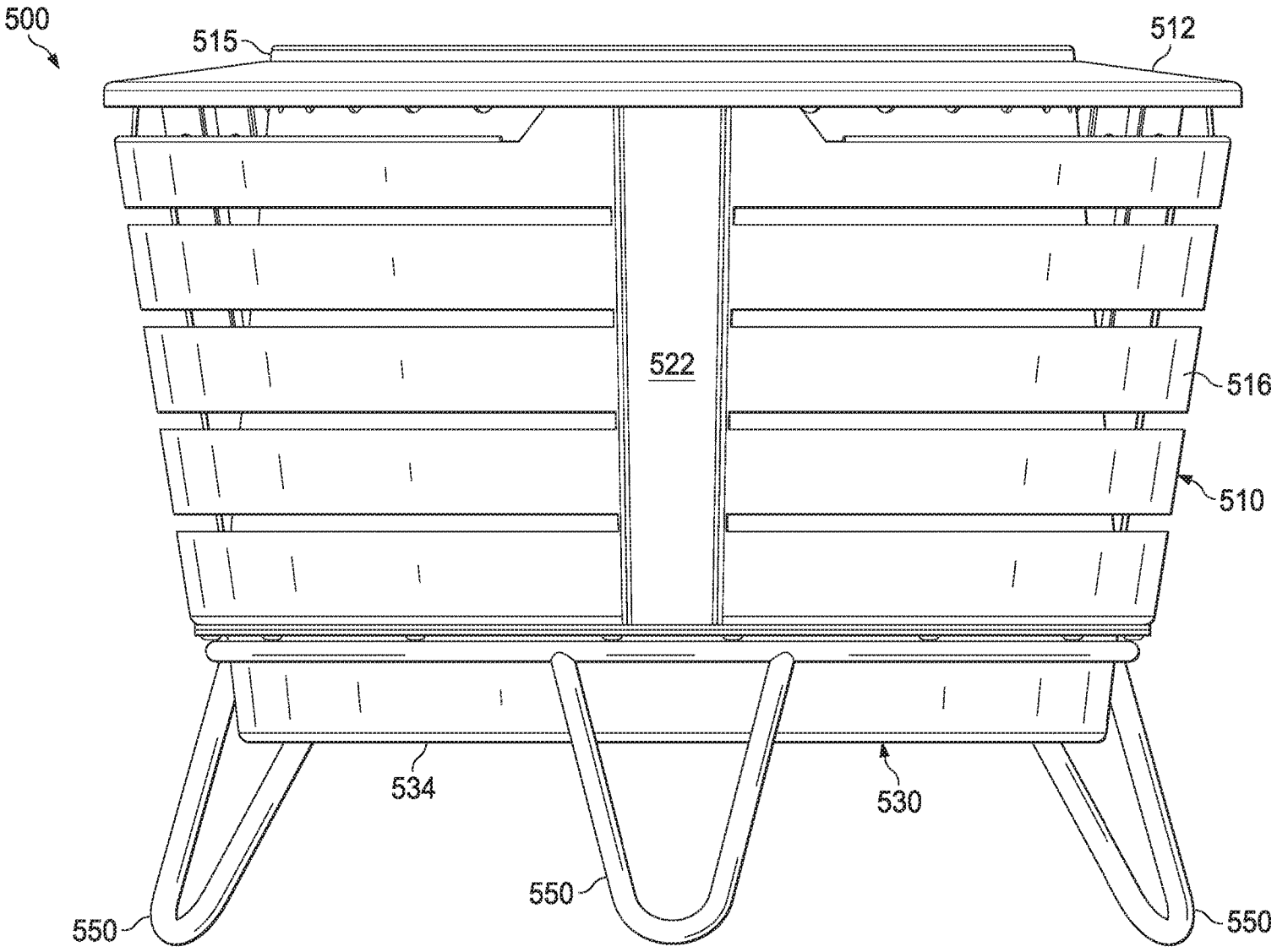
FIG. 6 is a side view of the fire pit of FIG. 5.
Figure 7:
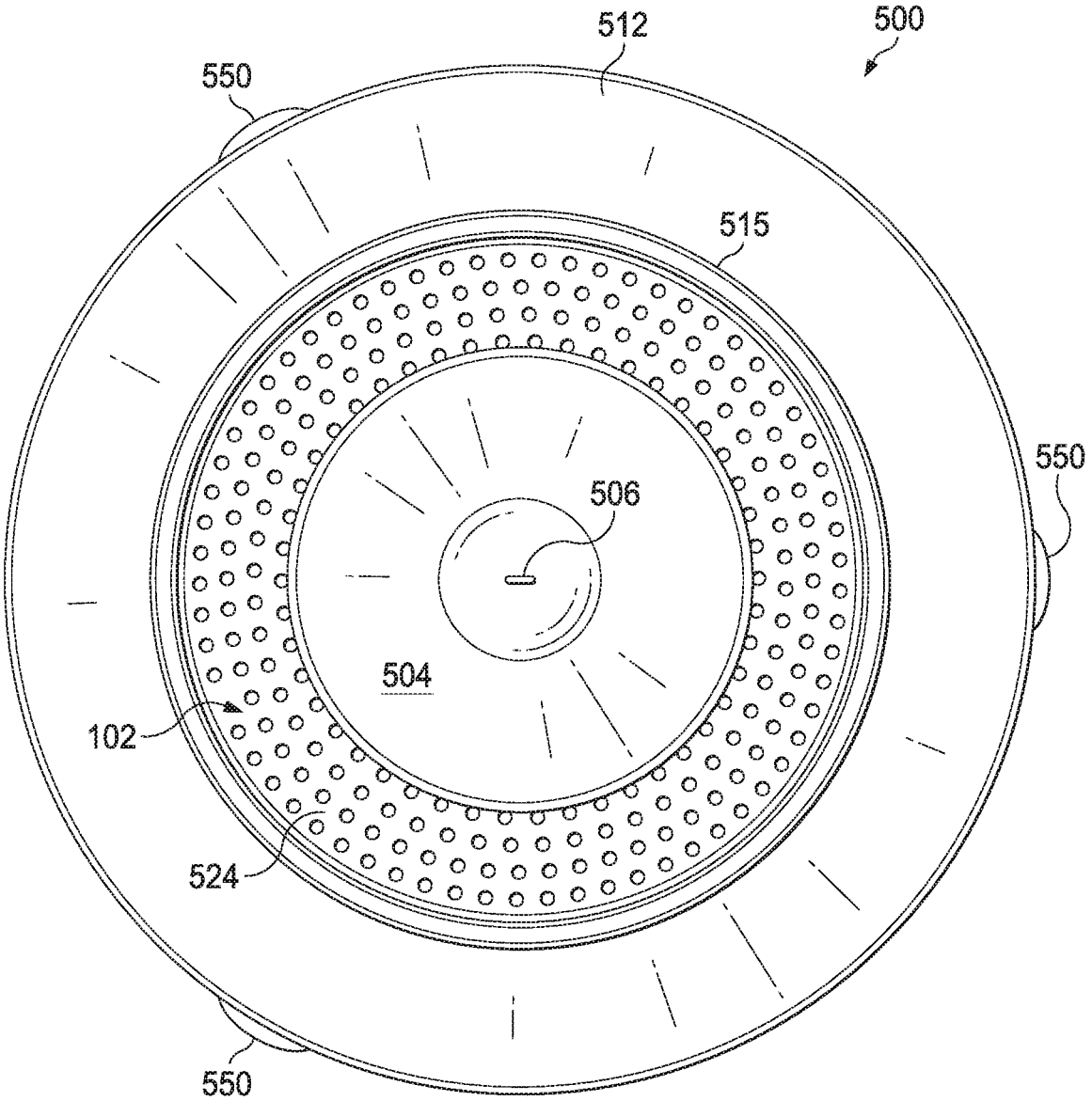
FIG. 7 is a top view of the fire pit of FIG. 5.
Figure 8:
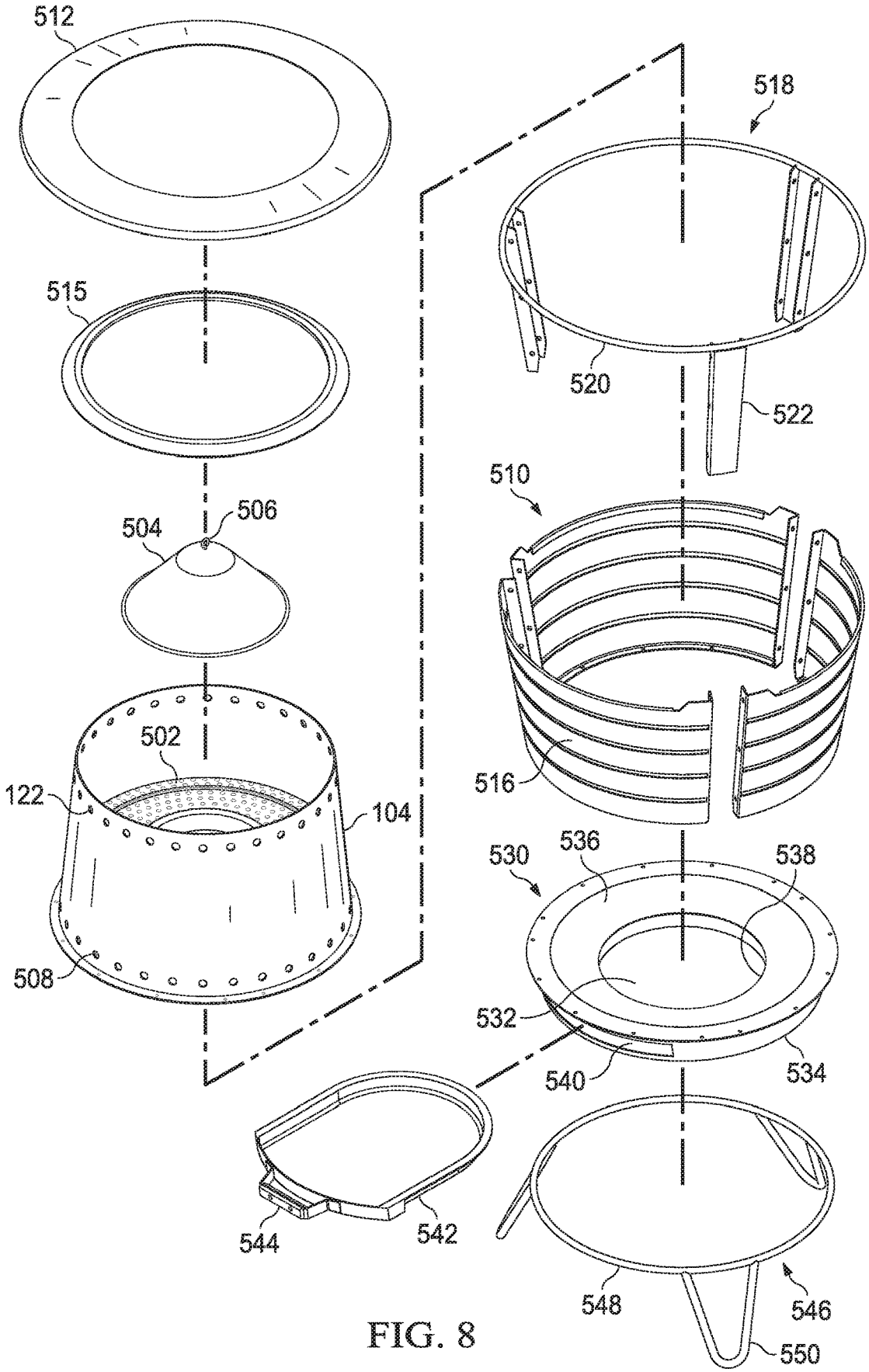
FIG. 8 is an exploded perspective view of the fire pit of FIG. 5.
Figure 9:
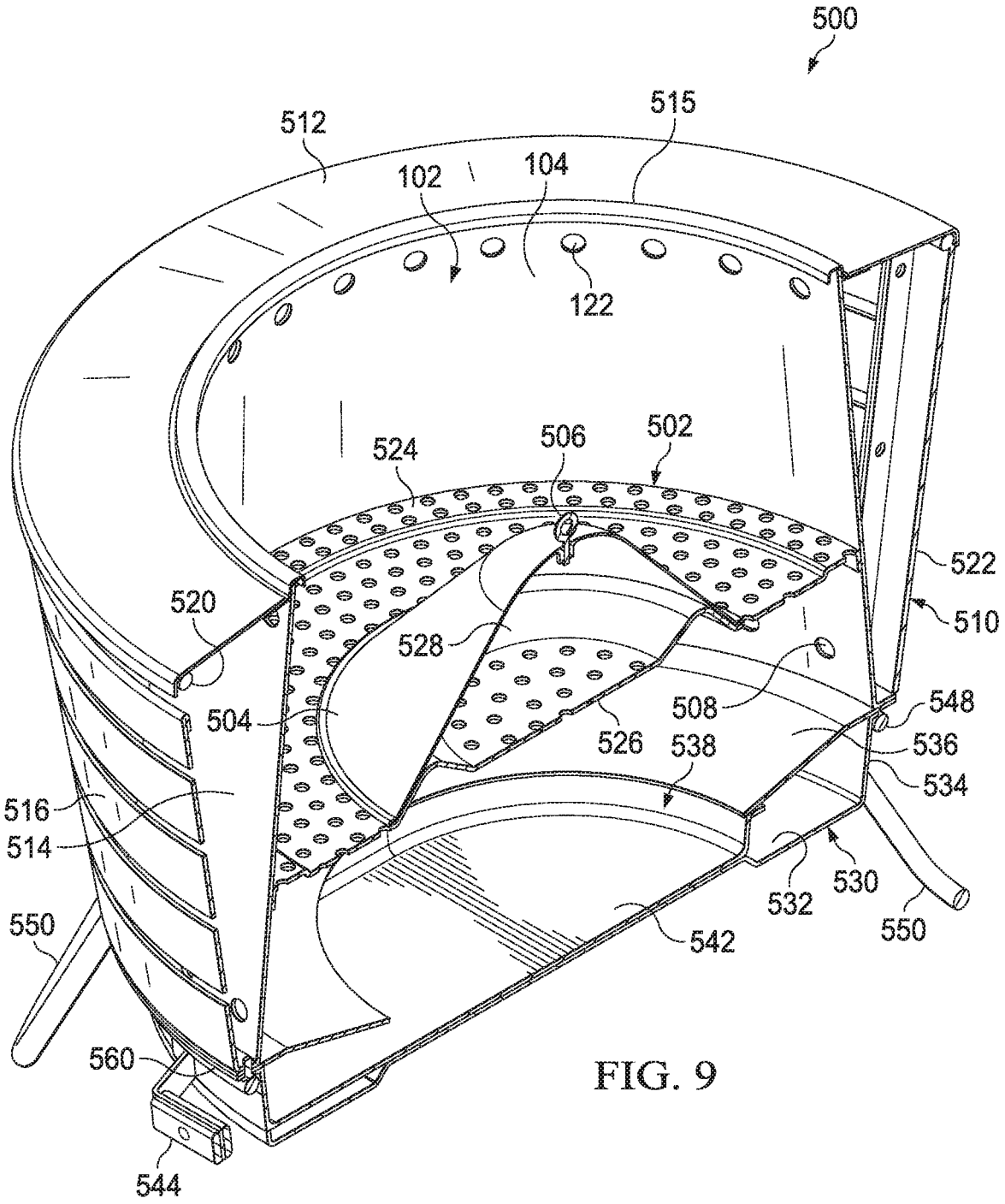
FIG. 9 is a side perspective cutaway view of the fire pit of FIG. 5.

Referring now to FIG. 5, a side perspective view of another embodiment of a fire pit 500 according to aspects of the present disclosure is shown. The fire pit 500 shares some features with the fire pit 100 discussed above but also differs in particular ways. FIG. 6 is a side view of the fire pit 500, while 7 is a top view, FIG. 8 is an exploded perspective view, and FIG. 9 is a side perspective cutaway view of the fire pit 500. FIGS. 5-9, taken together, may best illustrate the structure features of the fire pit 500.

The fire pit 500 comprises an inner chamber wall 104 defining an inner chamber 102, similar to the fire pit 100 discussed above. A fuel grate 502 is supported within the inner chamber 102 that is located medially between a top and bottom of the inner chamber wall 104, though in some embodiments it is nearer the bottom, as shown. The fuel grate 502 provides support for solid fuels to be burned in the fire pit 500. Being located or attached nearer the bottom of the inner chamber wall 104 means combustion takes place mostly within the inner chamber 102 and provides ample opportunity for radiative heating from the fire pit 500 without direct exposure to flame.

As best seen in FIG. 9, the fuel grate 502 is perforated to allow combustion air to flow therethrough, and as well as allowing ashes or spent fuel to fall through the fuel grate 502. The fuel grate 502 may be planar, generally planar, or flat with openings or perforations spread substantially evenly thereacross such that the entire fuel bed may be supplied with air as well as drained of ash or other debris. The fuel grate 502 may be round or generally round to mate with or affix to the circular inner chamber wall 104.

In some embodiments, the fuel grate 502 may be divided into an outer area 524 surrounding an inner area 526. The inner area 526 may be circular and the outer area 524 may be annular. In other embodiments the inner area 526 and outer area 524 have other cooperating shapes. Between the inner area 526 and outer area 524 may be a support ring 528. In the present embodiment, the support ring 528 is a short, sloped wall interposing the inner area 526 and outer area 524. It should be understood that the support ring 528, inner area 526, and outer area 524 may be separate regions of a contiguous fuel grate 502. The fuel grate 502 components may be formed as a monolithic whole (e.g., by machining or stamping) or may be fitted together after separate manufacture (e.g., by welding).

The support ring 528, in the present embodiment, locates a center deflector 504 that sits over the inner area 526 of the fuel support. The deflector 504 may be in configured as a cone that provides an outwardly sloping wall that tends to cause fuel placed into the inner chamber 102 to move toward the outer portion of the inner chamber 102, near the inner chamber wall 104. Thus, more combustion may take place near the inner chamber wall 104 to improve radiant heat transfer as well as the performance of the air flow mechanisms of the fire pit 500 discussed below.

The fire pit 500 may also be operated without the deflector 504, though the burn characteristics may change. A loop 506 may be provide for ease of removal of the deflector 504 by hand (if cool) or using a poker or other fire tool. The inner area 526 of the fuel grate 502 may be perforated similarly to the outer area 524. This may serve to aid in combustion if the fire pit 500 is operated without the deflector 504 and/or to facilitate ash removal or cleaning. It should be understood that the deflector 504, operating to urge fuel away from the center area 526 could comprise shapes different from that of a cone (although, in various embodiments, it would be advantageous to retain sloping walls or a similar feature). However, a cone-shaped deflector 504 in cooperation with a circular support ring 528 may be concentric to the outer area 524 of the fuel grate 502 as well as the inner chamber wall 104, thus promoting even burning and radiant heating all the way around the fire pit 500.

The inner chamber wall 102 may be frustoconical in shape, and narrower at the top than the bottom. It may define a plurality of primary air intakes or apertures 508 near the bottom thereof. The fuel grate 502 may be situated superior to, or above, these primary air intakes 508. Air entering these intakes 508 may ultimately provide initial combustion air to fuel on the fuel grate 502 as explained further below. Nearer the top of the inner chamber wall (in some embodiments, just below a top edge) are the apertures 122, which serve here as secondary air intakes. Air entering through these holes or apertures 122 may be heated by passing near an outside of the inner chamber wall 104 and provide additional oxygen for combusting unburned and possibly already heated combustibles (mostly in gaseous form) rising near the top of the inner chamber 102 from the fire below on the fuel grate 502.

Immediately outside the inner chamber wall 102 (where heating of secondary air occurs) may be a surrounding intake chamber 514. The intake chamber 514 serves as a manifold for air combing from outside the fire pit 500 and into the inner chamber 104 via apertures 508 and apertures 122. The intake chamber 514 may also be considered a heating chamber since this is where combustion air is primarily heated during operation of the fire pit 500.

The intake chamber 514 may be bounded on the outside by an outer wall 510. The outer wall 510 may be frustoconical but larger at a bottom thereof than a top. Thus, the outer wall 510 may be relatively close to, and possibly touching or connected to, the inner chamber wall 104 at or near the bottom of both of these. Toward the top of both the inner chamber wall 104 and the outer wall 510 these two components may be spaced apart. A top panel may close or cover the space between the inner chamber wall 104 and the outer wall 510 near or on the top of these. As can be seen in FIG. 9, for example, this may lend a triangular cross section to the intake chamber 514. The intake chamber 514 may generally define an annulus concentric with the inner chamber 102, which may provide even heating all around the fire pit 500.

In order to admit air from outside the fire pit 500, the outer wall 510 may have a slatted configuration. The outer wall 510 may comprise a number of spaced apart slats 510. Spacing between the slats 510 may vary but in some embodiments spacing between each set of adjacent slats 516 is the same or substantially the same. Little spacing may be needed to admit sufficient air and it may be advantageous to space the slats fairly close together to improve heating of air in the intake chamber 104. As with other components of the fire pit 500 the slats may comprise a metal to promote even and adequate radiant heating outside the fire pit.

As may be best seen in FIG. 8, each slat 516 may not define a complete circle around the inner chamber wall 104, but may represent only a portion of a circle arc. In some embodiment, each slat (e.g., at each level) may be broken into three arcs. A wall frame 518 may provide a top ring 520 from which descends one or more support members 522. The slats 516 may affix to these support members 522, which may be equidistantly spaced from one another around the top ring 520. In the illustrated configuration, the slats 516 run horizontally or generally horizontally. Thus, air is supplied into the intake chamber 514 in a substantially concentric manner to the inner chamber wall 102. The support members 522, at least where their number is limited (e.g., here to three) do not substantially interfere with even air flow or heating. In other embodiments, a series of vertical slats may be used. In further embodiments, the outer wall 510 may be a solid component that has had openings (vertical or horizontal) cast into it (or milled, cut, or punched therefrom).

The intake chamber 514, the inner chamber 102, and the components defining those parts, may sit atop or affix to a base 530. The base 530 may support the intake chamber 514 and inner chamber 102 above the ground and provide ash handling capabilities. The base 530 may comprise a floor 532 affixed to a surrounding outer wall 534. Over the floor 532 and below the fuel support grate 502 a funnel 536 may be provided with a central opening 538. The funnel 536 urges ash and debris from combustion toward the center of the floor 532.

An opening 540 (FIG. 8) may be defined in the wall 534 for accepting a removable ash pan 542 situated below the opening 538 of the funnel 536. A heat resistant handle 544 (comprising, e.g., wood or plastic) may affix to the ash pan 542 for removal and insertion of the ash pan 542.

The base 530 may also be fitted with a stand 546 (FIG. 9). The stand 546 may comprise a support ring 546 which may receive the base 530 as well as locate legs 550. Three legs 550 are shown but more or fewer (depending on their shape) could be utilized. As can be seen in FIG. 9, the support ring 548 of the stand 546 may fit into a lip 560 on the wall 534 of the base 530. The outer wall 510 and the inner chamber wall 104 may each also affix to this lip 560 or another nearby location.

As discussed above, the outer wall 510 may provide a wall frame 518 having a top ring 520. This may serve as a point to which the top panel 512 affixes to span the space between the outer wall 510 and the inner chamber wall 104 (in other embodiments the top panel 512 may attach elsewhere, e.g., to a top slat 516). A chamber top ring 515 may join the top panel 512 to the top of the inner chamber wall 104, or these components may join without a fastener (e.g., by folding together) or by welding. In any event, the top panel 512 is securely fixed to retain the outer wall 510 in a spaced apart relationship from the inner chamber wall 104. The top panel 512 also, therefore, partially defines the intake chamber 514 and prevents air from escaping.

Figure 10:
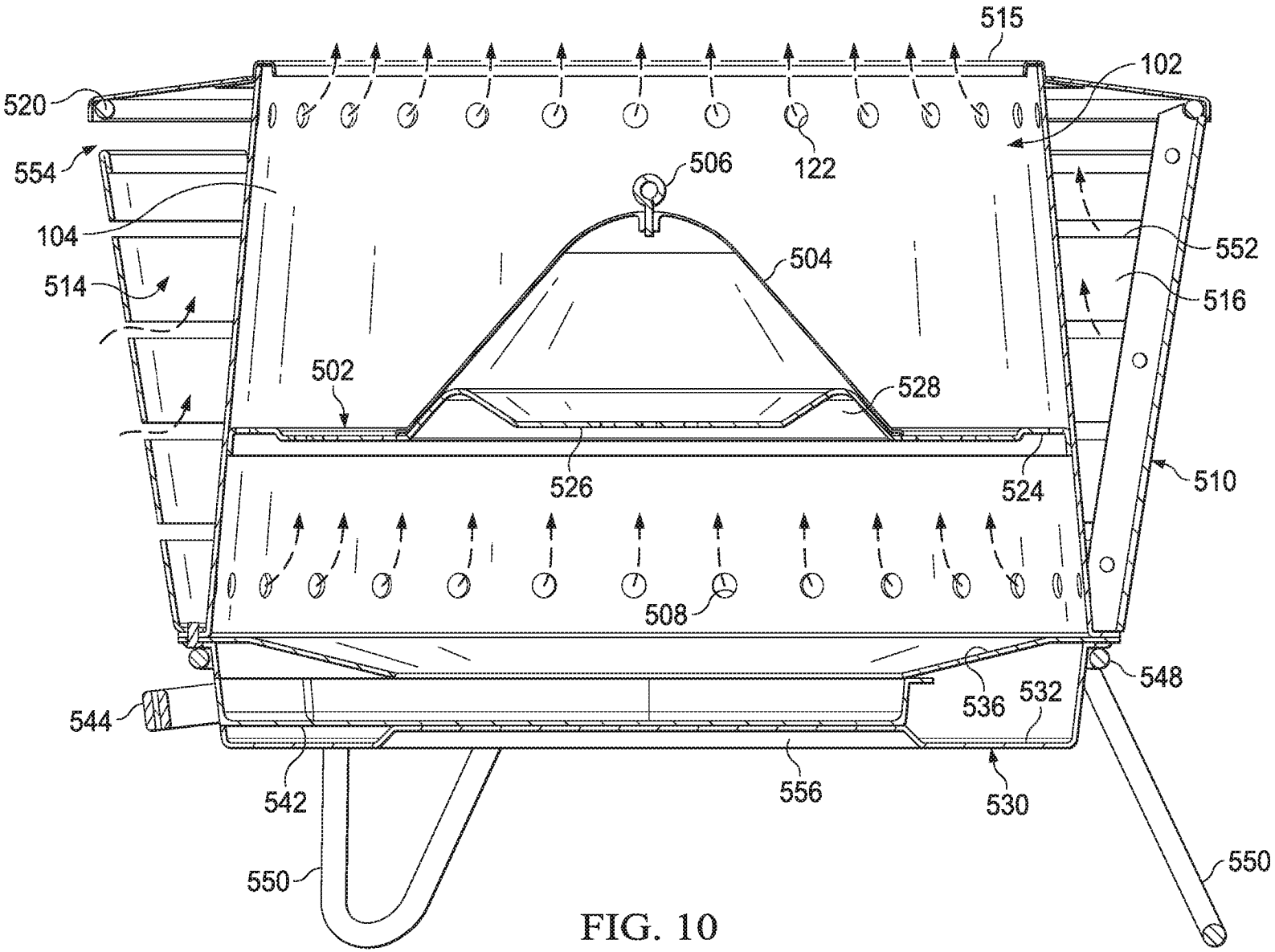
FIG. 10 is a side cutaway view of the fire pit of FIG. 5 illustrating exemplary air flow through the device in operation.

Referring now to FIG. 10, a side cutaway view of the fire pit 500 of FIG. 5 illustrating exemplary air flow through the device in operation is shown. Air can be seen to enter into the intake chamber 514 from outside the fire pit 500 via spaces 552 between adjacent slats 516 and space 554 between the top of the slats 516 and the top panel 512. Some air from the intake chamber 514 (particularly from spaces between some of the lower of the slats 516) is drawn through primary air intake apertures 508 and to and through the fuel grate 502. As shown, this air will particularly flow to and through the outer area 524 of the fuel grate 502 if the deflector 504 is in place. If the deflector 504 is not in place, air flows to and through the inner area 526 more readily as well. Air entering the inner chamber 102 via primary air intakes 508 may not be particularly heated.

Air entering the intake chamber 514 may also flow up along the inner chamber wall 104, which may have a relatively high temperature owing to the fire operating inside the inner chamber 102 (and particularly on or near the outer area 524 of the fuel grate 502). Such air will become heated via radiant and convective heating. The heated air rises to the apertures 102 where in enters the inner chamber 102 near the top thereof. As discussed above, gases coming from the combusting fuel on the fuel grate 502 generally include unburned flammables. Limited oxygenation from the primary combustion air (even where primary combustion air flow is not restricted) is one cause of the unburned flammables. In some cases, injection of secondary air does little to promote further consumption of these unburned flammables because of the relatively low temperature of the ambient air. Here, however, the secondary combustion air is heated within the intake chamber 514 and is more useful for further burning of the unspent fuel. This secondary burning provides additional heating as well as a reduction in smoke.

From the view of FIG. 10, it can also be seen that the floor 532 of the base 530 may provide a support 556 for receiving the ash pan 542 and supporting it in the best location below the funnel 536 (e.g., under the opening 538 shown in FIG. 9).

Dimensions of the fire pit 500 may vary. However, in one embodiment the height of the fire pit, including the legs 550, is about 19.3 inches. Exclusive of the legs 550, the height may be about 14.9 inches. A total diameter of the fire pit 500 may be about 24.6 inches. Thus, the fire pit 500 may be conveniently sized to provide a usable fire, yet small enough to be moved.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit comprising:

an inner chamber wall circumscribing and defining an inner chamber;

a plurality of primary air apertures defined through the inner chamber wall at a first, lower level;

a plurality of secondary air apertures defined through the inner chamber wall at a second, upper level; and a fuel grate supported within the inner chamber at a level between the lower level and the upper level;

wherein solid fuel supported by the fuel grate, when combusted, is provided primary combustion air from below the fuel grate by the primary air apertures and provided secondary combustion air from above the solid fuel by the secondary air apertures, the secondary combustion air promoting combustion of unburned gasified combustibles rising within the inner chamber; and wherein the inner chamber wall is frustoconical and is narrower toward a top thereof.

2. The fire pit of claim 1, further comprising an outer wall surrounding the inner chamber wall, the inner chamber wall and the outer wall defining an air intake chamber wherein air rises in proximity to the inner chamber wall and is heated before passing into the secondary air apertures.

3. The fire pit of claim 2, wherein the outer wall defines at least one space for air to enter the air intake chamber from outside the fire pit.

4. The fire pit of claim 3, wherein the outer wall comprises a plurality of spaced apart slats.

5. The fire pit of claim 4, wherein the plurality of spaced apart slats are oriented horizontally.

6. The fire pit of claim 4, wherein the outer wall is frustoconical and is narrower toward a bottom thereof.

7. The fire pit of claim 6, further comprising a top panel spanning a distance between the top of the inner chamber wall and a top of the outer wall.

8. The fire pit of claim 7, wherein the air intake chamber is toroidal.

9. The fire pit of claim 1, further comprising a deflector seated on the fuel grate and having a wall sloping downward and away from above a central, inner area of the fuel grate such that fuel will tend to slide away from the central, inner area of the fuel grate to combust on an outer annular area of the fuel grate proximate the inner chamber wall.

10. The fire pit of claim 9, wherein the deflector is conic and is located on the fuel grate by a support ring on the fuel grate, the support ring defining a boundary between the inner area of the fuel grate and the outer area of the fuel grate.

11. The fire pit of claim 1, further comprising a base below the inner chamber, the base providing a floor surrounded by a wall and a funnel for moving ash from the fuel grate toward a center of the base.

12. The fire pit of claim 11, wherein the base further comprises a removable ash pan inserted by an opening defined in the base wall.

13. A fire pit comprising:

an inner chamber wall circumscribing and defining an inner chamber;

a plurality of primary air apertures defined through the inner chamber wall at a first, lower level;

a plurality of secondary air apertures defined through the inner chamber wall at a second, upper level;

a fuel grate supported within the inner chamber at a level between the lower level and the upper level; and an outer wall surrounding the inner chamber wall to define an air intake chamber therebetween;

wherein solid fuel supported by the fuel grate, when combusted, is provided primary air from below the fuel grate by the primary air apertures and provided secondary air above the solid fuel by the secondary air apertures, the secondary air promoting combustion of unburned gasified combustibles rising within the inner chamber;

wherein at least some air entering the inner chamber via the secondary air apertures is heated by passing in proximity to the inner chamber wall through the air intake chamber; and wherein the inner chamber wall is frustoconical with a smaller upper end and a larger lower end and the outer wall is frustoconical with a larger upper and a smaller lower end, the inner chamber wall and the outer wall joining at the lower ends thereof and being spaced apart at the upper ends thereof, the space being covered by a top panel to enclose the air intake chamber.

14. The fire pit of claim 13, wherein the outer wall comprises a plurality of horizontally oriented, spaced apart slats, spaces between the slats admitting air from outside the fire pit to the air intake chamber.

15. The fire pit of claim 14, wherein the primary air apertures are fed combustion air from the air intake chamber.

16. The fire pit of claim 14, wherein the fuel grate further comprises a centrally located deflector urging fuel away from a center of the fuel grate and toward an outer area proximate the inner chamber wall.

17. The fire pit of claim 16, wherein the deflector, the fuel grate, the inner chamber wall, and the outer wall are all concentrically arranged with respect to one another.

18. The fire pit of claim 17, further comprising a base below the fuel grate providing a funnel feeding into an ash pan for capturing ash falling through the fuel grate.

* * * * *